United States Patent [19]

Toth et al.

[11] Patent Number: 4,648,327

[45] Date of Patent: Mar. 10, 1987

[54] SAFE LOCKING MECHANISM

[75] Inventors: John E. Toth, Cottonwood, Ariz.; Ronald L. Hempfling, Poway, Calif.

[73] Assignee: Cubic Western Data, San Diego, Calif.

[21] Appl. No.: 750,930

[22] Filed: Jul. 1, 1985

[51] Int. Cl.[4] ..... E05G 1/00

[52] U.S. Cl. ..... 109/57; 109/55; 109/66

[58] Field of Search ..... 109/53, 55, 67, 46, 109/66, 57, 59 R; 232/7, 12, 15, 16, 43.2

[56] References Cited

U.S. PATENT DOCUMENTS

| | | | |
|---|---|---|---|
| 1,499,904 | 7/1924 | Bell et al. | 232/7 |
| 1,512,515 | 10/1924 | Woods | 232/7 |
| 3,016,185 | 1/1962 | Osborne | 232/15 |
| 3,083,896 | 4/1963 | Cairelli et al. | 232/15 |
| 3,108,741 | 10/1963 | Thomas | 232/43.2 |
| 3,807,628 | 4/1974 | Bock | 232/16 |
| 3,966,116 | 6/1976 | Dominick et al. | 232/16 |
| 3,974,961 | 8/1976 | Dominick et al. | 232/16 |
| 4,201,333 | 5/1980 | Oslin et al. | 232/16 X |
| 4,380,316 | 4/1983 | Gunka et al. | 232/16 |
| 4,471,905 | 9/1984 | Sloma et al. | 232/12 |

*Primary Examiner*—William F. Pate, III
*Assistant Examiner*—Jean M. LaKemper
*Attorney, Agent, or Firm*—Brown, Martin, Haller & Meador

[57] ABSTRACT

A locking mechanism for a mobile safe having at least one loading door for depositing valuables such as cash within the safe and at least one unloading door for emptying the safe includes an actuating mechanism for moving the loading door between its open and closed positions. The actuating mechansim extends out of the safe for engagement with a vault door locking mechanism when the safe is placed within an outer vault for secure deposit of cash into the safe. The engagement is such that the actuating mechanism operates to open the loading door as the vault door is locked. A locking device associated with the actuating mechanism automatically locks the safe door in its closed position and can only be released by subsequent unlocking or opening of the unloading door by a person having the required key.

11 Claims, 9 Drawing Figures

SAFE LOCKING MECHANISM

BACKGROUND OF THE INVENTION

The present invention relates to a mechanism for locking a container for valuables such as a safe or money box of the type having two doors or access openings, one for loading items such as currency and the other for unloading the items when the safe is full.

Mobile safes having upper loading doors and lower unloading doors are commonly used in vaults for depositing the contents of fare boxes or coinboxes used, for example, in automatic vending machines for transportation tickets or other articles. In one typical case a transportation system will have automatic ticket machines on buses or at transit stops, for example, in which travellers can deposit money to purchase a ticket. The machine will have a removable secure cash or money box for collecting the money. Full cash boxes must be removed and replaced periodically by an operator. They may contain coins and note currency. The full cash boxes are normally taken to a vault where the money they contain is transferred into a secure safe within the vault. When the safe is full it must itself be removed from the vault for emptying via its unloading doors in a secure counting room.

The mobile safe must therefore be securely locked when removed from the vault so that neither the loading or unloading doors can be opened without the necessary master key. The locking mechanism must be relatively tamper-proof to reduce the risk of theft. At the same time the upper loading door of the safe must be releasable when the safe is within the vault or outer housing so that money can be deposited in the housing.

Thus in the past various locking mechanisms have been devised for mobile safes and coinboxes which automatically lock the loading door when the safe is released from the outer housing, and allow the loading door to be opened only when the safe or coinbox is empty and locked in the outer housing or vault.

In U.S. Pat. No. 3,016,185 of Osborne a coinbox is described which has an upper chute for depositing money in the coinbox when it is locked in the outer housing. In order to remove the coinbox an operator must turn a key to release latch arms on the coinbox from openings in the housing. Rotation of the key also acts to slide a plate into place to obstruct the chute. Thus the coinbox can only be removed when the chute is blocked. The operator is prevented from turning the key back to release the chute when the coinbox has been removed from the housing by a ratchet and pawl mechanism which is engaged by unlocking rotation of the key. This mechanism must be released once the coinbox has been emptied at a central location to allow the chute to be re-opened when the empty box is replaced in a housing, and this is done with a master key.

A similar type of coinbox locking device is described in the U.S. Pat. No. 3,083,896 of Cairelli et al in which a coinbox is locked in a container by means of a bolt. The bolt is actuated by a two key operated lock assembly. The bolt actuates a blocking lever to prevent access to the coin slot when the box is released from the container.

In U.S. Pat. No. 3,108,741 of Thomas a mechanism is described in which cash openings in a cash vault are opened by engagement of a stud on the vault with a coin plate mounted on the underside of the coin machine and locked closed by removal of the vault from the machine.

SUMMARY OF THE PRESENT INVENTION

It is an object of the present invention to provide a mobile safe which is relatively secure against tampering.

According to the present invention a mobile safe or other container for receiving valuables such as cash is adapted for mounting within an external lockable vault or housing for receipt of cash or other valuables either by external deposit or from a coinbox also placed within the vault. The safe has a loading door for receiving cash or other valuables, and an unloading door for removing cash when the safe is full and transported from the vault to a counting room, for example. Each door is associated with its own locking mechanism, and the unloading door locking mechanism is released by means of a key provided only to the counting room staff or other authorized personnel.

According to the invention the loading door locking mechanism is associated with an external operating device movable between a first position in which the loading door is open and a second position in which the loading door is closed and locked. The operating device is positioned so as to be actuated by the vault door locking mechanism when the safe is placed in the vault and the vault door is closed. The action of locking the vault door moves the operating device into the first position, and unlocking the vault door moves the operating device into the second position to lock the loading door. Thus the safe can only be removed from the vault when the loading door is securely locked.

Preferably the loading door locking mechanism includes a latching device which is engaged when the loading door is locked and which is linked to the unloading door locking mechanism so as to be released when the unloading door is unlocked in the counting room. Thus unlocking of the unloading door acts to re-arm the loading door locking mechanism so that the loading door can be opened when the safe has been emptied and returned to the vault. However once the loading door has again been closed and re-locked it can only be opened again after the unloading door key has been turned to release the unloading door.

With this arrangement the person transporting the mobile safe has no opportunity for access to the interior of the safe unless the safe is empty. The safe cannot be removed from the vault without automatically locking the loading door, and the unloading door cannot be opened without a key.

In one preferred embodiment of the invention the safe locking assembly includes a lower unloading door locking mechanism comprising a key actuated latch for engagement in a sliding mechanism to lock the unloading door and an upper loading door locking mechanism comprising a rotatable shaft for moving the upper door between its open and closed positions, an external operating device for rotating the shaft, a latching member mounted on the shaft, and a latch for engagement in the latching member in the closed position of the upper door. The lower door latch acts on a lever arm for urging the upper door latch out of latching engagement with the latching member when the lower door key is turned to unlock the lower door. Subsequent rotation of the shaft to open the upper door returns the latch into a latching position so that when the upper door is closed the latch re-engages the latching member.

In one example the latching member comprises a latch wheel mounted on the upper door operating shaft and having a cut-out notch. The latch comprises a latch lever having a pawl for engagement in the latch wheel notch to prevent rotation of the operating shaft. A pawl and notch are aligned in the closed position of the loading door, and the pawl is urged into the notch by the spring. A cam is also mounted on the operating shaft so as to release the upper door latch lever whenever the operating shaft is rotated in a direction to open the upper door, thus re-arming the latch. When released by the cam, the pawl will therefore be urged against the outside of the latch wheel and will be able to fall into the notch whenever the upper door is reclosed.

The operating shaft is rotated by means of the external operating device which acts to rotate a crank mounted on the shaft. A pin on the crank engages a cut-out in a cam mounted on the inside of the vault door lock so that the upper door can only be opened to receive cash when the vault door is locked, and can only be released by unlocking the vault door, which recloses and locks the safe upper door.

It is therefore an advantage of this invention that a relatively secure mobile safe locking mechanism is provided which restricts access to the safe when it is full except by authorized personnel having the required key.

BRIEF DESCRIPTION OF THE DRAWINGS

The above and other objects and advantages of the present invention will be apparent to those skilled in the field from the following detailed description of a preferred embodiment of the invention, taken in conjunction with the accompanying drawings, in which like reference numerals refer to like parts and in which:

FIGS. 2, 4, and 6 are sectional views similar to FIG. 3 showing successive positions of the lock mechanisms;

DESCRIPTION OF THE PREFERRED EMBODIMENT

Figure 9:
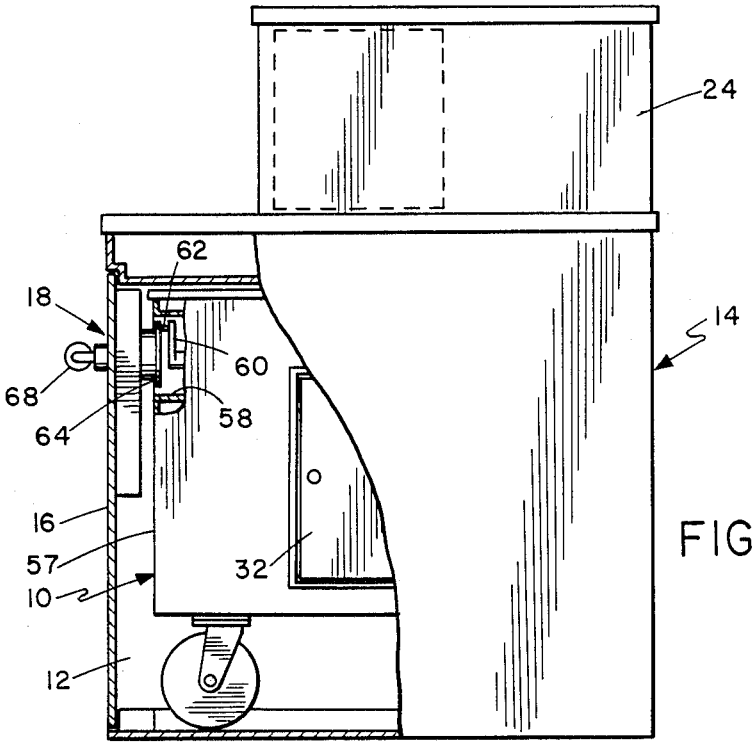
FIG. 9 is a side elevation view of a fixed vault, partially cut away to show the mobile safe inside and coupled to the vault lock.

The drawings illustrate a mobile safe 10 or other container for receiving valuables such as money. The safe 10 is intended to be contained within an external housing such as a lower chamber 12 in an externally lockable vault 14 as shown in FIG. 9. The vault lower chamber 12 has an access door 16 which is locked by external locking mechanism 18.

Figure 1:
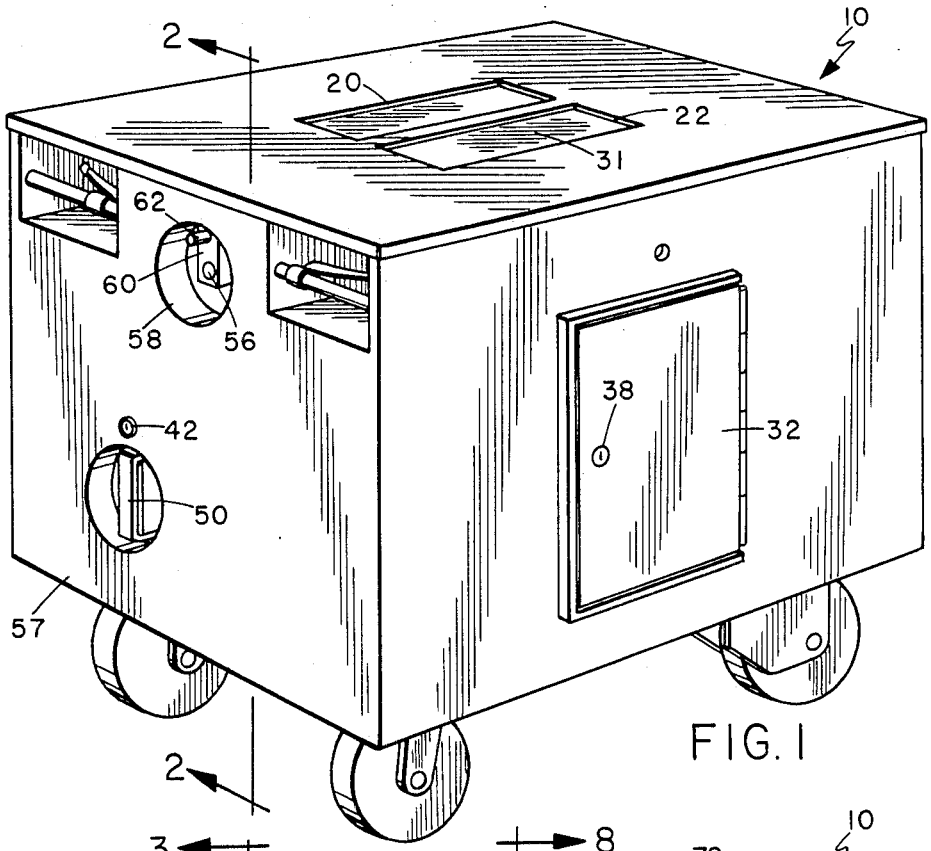
FIG. 1 is a perspective view of the mobile safe.
Figure 2:
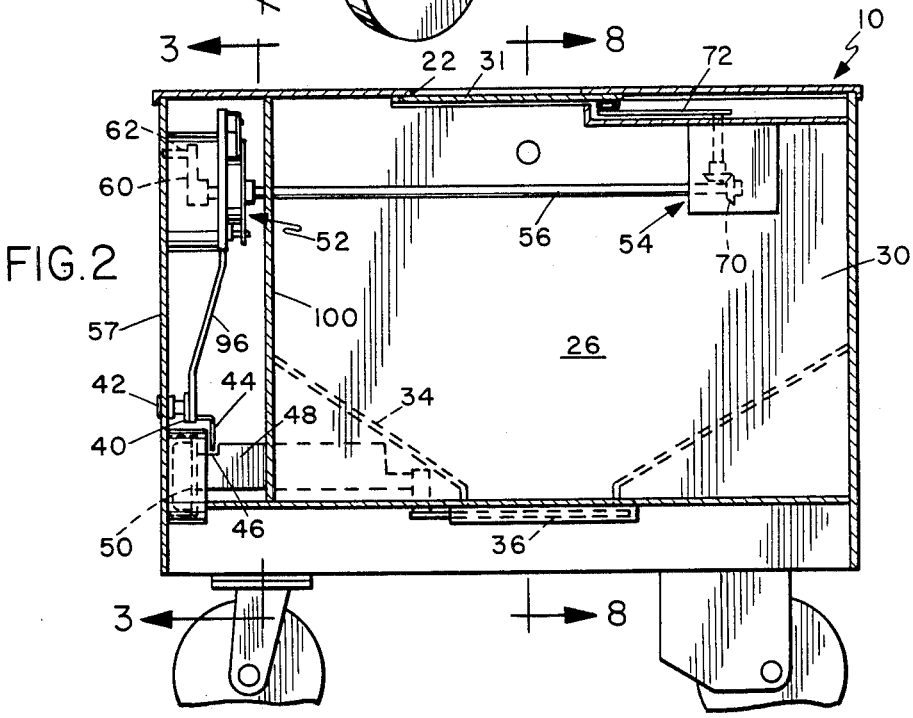
FIG. 2 is a sectional view taken on Line 2—2 of FIG. 1.
Figure 8:
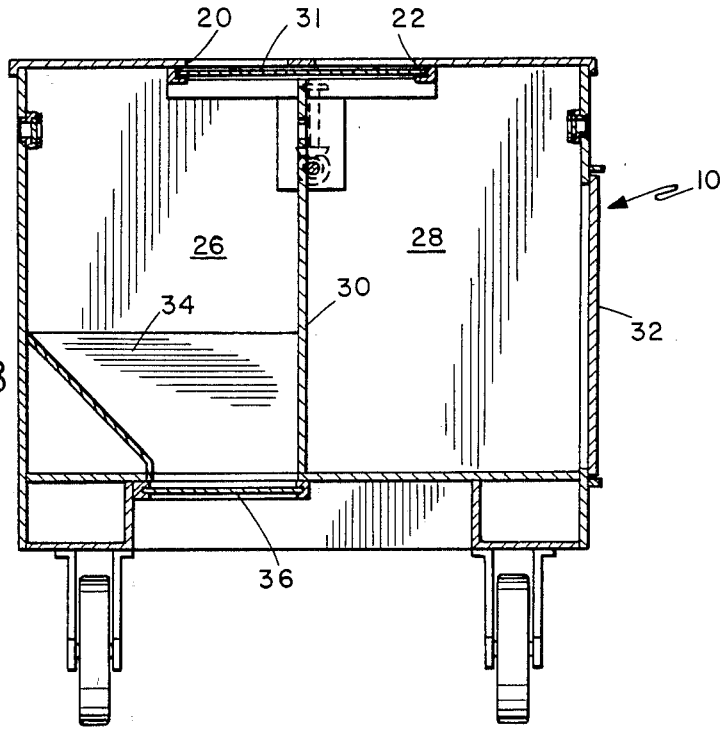
FIG. 8 is a sectional view taken on Line 8—8 of FIG. 2.

As shown in FIG. 1, the safe 10 has upper loading openings 20, 22 for deposit of money in the form of coins and bills, respectively, into the safe. Money will be deposited automatically from a money box (not shown) located in an upper chamber 24 of the vault (see FIG. 9). The safe includes coin and bill chambers 26, 28 separated by a center wall 30 as shown in FIGS. 2 and 8 for receiving coins and bills, respectively. An upper sliding door 31 is provided for closing the openings 20, 22. A lower unloading door 32 in the side wall of the safe, shown in FIG. 1, communicates with the bill chamber 28, and a chute 34 communicating with the coin chamber 26 opens into the lower wall of the safe for unloading coins from the safe. The lower opening of the coin chute 34 is normally closed by a slide door 36, as seen in FIG. 2.

Lower bill unloading door 32 is locked by a locking mechanism 38 which can be unlocked by a key. Similarly, the coin unloading or slide door 36 is locked by a locking mechanism 40 operated by a key engaging in lock 42. The key or keys necessary to open the coin and bill unloading doors will normally only be provided to authorized personnel for use in a secure counting room.

As best shown in FIGS. 2, 3, 4, and 7, the lower coin unloading door locking and releasing mechanism 40 includes key-operated latch 44 engaging in a notch 46 in lower door slide mechanism 48. Rotation of a key in the lock 42 acts to rotate the latch 44 out of the notch 46, allowing the slide mechanism 48 and door 36 to be pulled out via handle 50 to open the chute 34.

The upper loading slide door 31 of the safe is associated with a locking mechanism 52 which must be released in order to allow the slide door to be opened for deposit of coins and bills into the safe.

Figure 7:
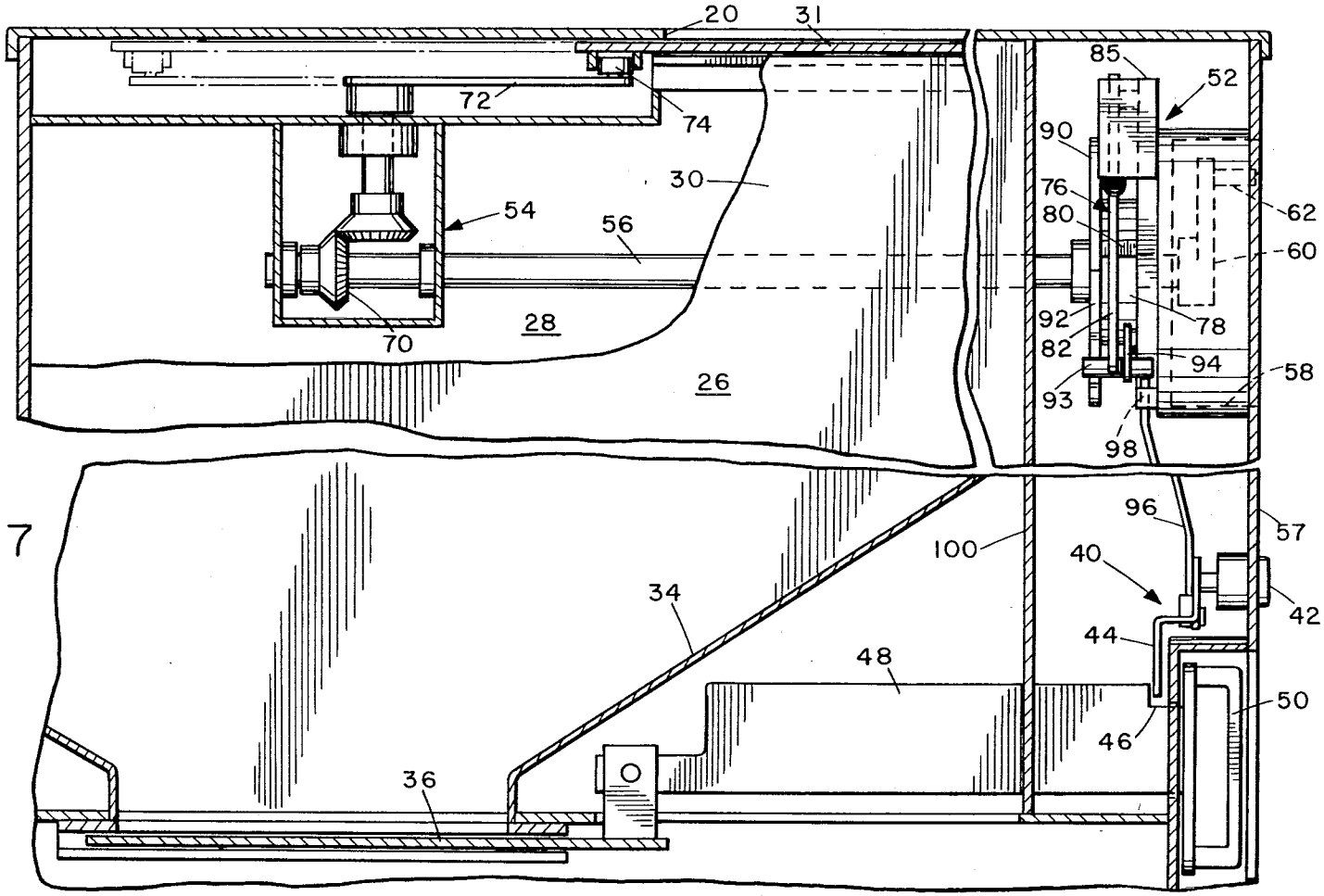
FIG. 7 is a sectional view taken on Line 7—7 of FIG. 3 and including the interconnected upper and lower sliding door mechanisms.

An actuating mechanism 54 for moving the upper slide door between its open and closed positions is associated with the locking mechanism 52. As best shown in FIG. 7, the actuating mechanism includes a rotatable shaft 56 projecting out of an end wall 57 of the safe into a recess 58 in the end wall. An operating device for rotating the shaft comprises a crank 60 mounted on the outer end of the shaft and having an outwardly projecting pin 62 at its free end. The end wall 57 is the wall which will face the vault door when the safe is correctly mounted in the vault chamber as shown in FIG. 9, and the recess 58 is positioned to cooperate with a projecting plate 64 of the vault door locking mechanism when the vault door is closed. If the crank is in the correct orientation, the pin 62 will engage in a recess or notch (not visible) in the plate 64, so that rotation of a key or handle 68 in the vault door lock will also rotate the crank, and thus the shaft 56.

As best shown in FIGS. 2 and 7, shaft 56 is linked via a right angled gear drive mechanism 70, a crank 72, and a roller 74, operating in a Scotch yoke, to the upper slide door 31 so that rotation of the shaft 46 in opposite directions will cause the door to move between the closed and open positions illustrated in FIG. 7.

The upper slide door locking mechanism 52 controls rotation of the shaft 56. As seen in FIGS. 3 to 7, the mechanism 52 is mounted on the inner face of the safe wall 57, and includes a latching device 76 comprising a latch wheel 78 having a notch 80 and a latch member or lever 82 having a pawl 84 for cooperating engagement in the notch 80. The latch wheel 78 is mounted on the shaft 56 so as to rotate with rotation of the shaft. The latch lever 82 is pivotally mounted at one end on a mounting plate 85 secured to the safe wall 57 and is urged by means of a biassing spring 86 towards its locking position.

The locking mechanism 52 also includes a latch arming mechanism 88 including a rotating cam plate 90 mounted on the shaft 56. The cam plate has a cam surface 92 for engaging a cam roller 93 mounted to extend transversely through the free end of an arm 94 (see FIG.

7) which is pivotally mounted at its other end on mounting plate 85. A lock releasing mechanism for releasing the upper door lock comprises a lift or latch bar 96 which is linked at its lower end to the lower slide door locking latch (see FIGS. 3, 4, and 7) and projects upwardly through a guide slot 98 in mounting plate 85 to act on one end of the cam roller 93, as best seen in FIG. 7.

Figure 3:
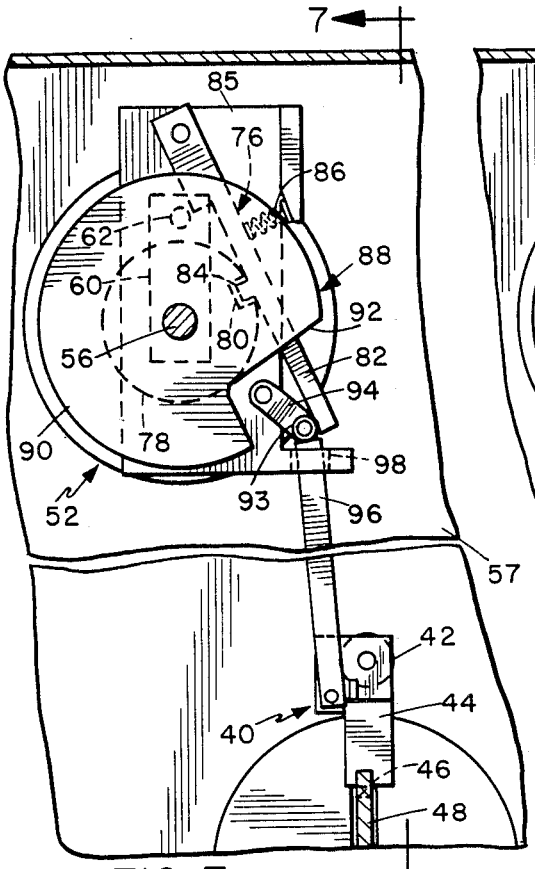
FIG. 3 is an enlarged sectional view taken on Line 3—3 of FIG. 2 showing the lock mechanism in locked position.
Figure 4:
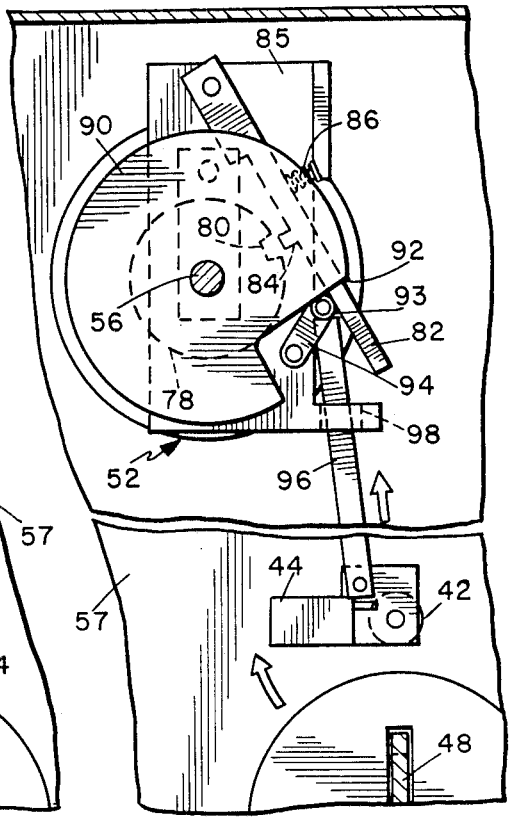

Operation of the locking mechanism 52 will now be described in more detail with reference to FIGS. 3 to 7. FIG. 3 shows the locking mechanism in a locked position, in which shaft 56 cannot be rotated because of the engagement of pawl 84 in the notch 80 in latching wheel 78. In this position the upper slide door 31 is locked closed and access to the interior of the safe is prevented.

The locking mechanism 52 can only be released by operation of the lower coin door lock 42, as shown in FIG. 2. Rotation of a key to rotate the lower slide door latch 44 to release the slide mechanism 48 will also act to push the latch bar 96 upwards, pushing the roller 93 and thus the arm 94 upwards into an over center position and at the same time lifting the pawl 84 out of the notch 80, thus releasing the latching device 76. The roller 93 at this point acts as a retaining or holding mechanism for retaining the latch lever 82 in its released position. This action also brings cam roller 93 into engagement with cam surface 92.

Figure 5:
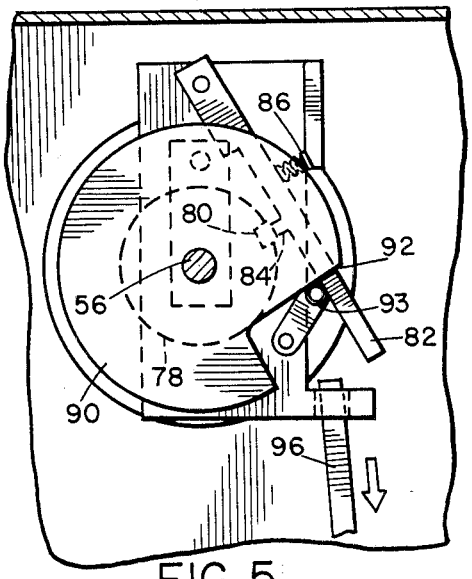

If the mobile safe lower door is now re-locked, the latch bar 96 will be retracted as shown in FIG. 5. The roller 93 and thus the arm 94 remain jammed in the raised position between the spring-loaded latch lever 82 and the mounting plate 85, and the roller therefore acts to hold the latch lever away from the latch wheel.

If the mobile safe is now returned to a vault and positioned as shown in FIG. 9, closing of the vault door 16 will cause the vault door locking mechanism 18 to engage the operating device 54. Pin 62 on the crank 60 will engage in a notch on the vault door lock rotating plate 64. Rotation of a key in the vault door locking mechanism, or rotation of a vault door handle to lock the vault door, will also act to rotate the crank 60 and thus the shaft 56. Rotation of the shaft 56 also rotates the latch wheel 78 and the cam plate 90 in a clockwise direction into the positions shown in FIG. 6, in which the notch 80 is out of alignment with the pawl 84 and the cam roller 93 has been pushed down by its engagement with cam surface 92 to release the pawl 84 and to re-engage the latch bar 96. Thus the cam surface 92 acts as a re-arming mechanism to release the cam roller 93 and allow the pawl 84 to be urged against the latch wheel. The pawl now rides on the outer edge of latch wheel 78.

Figure 6:
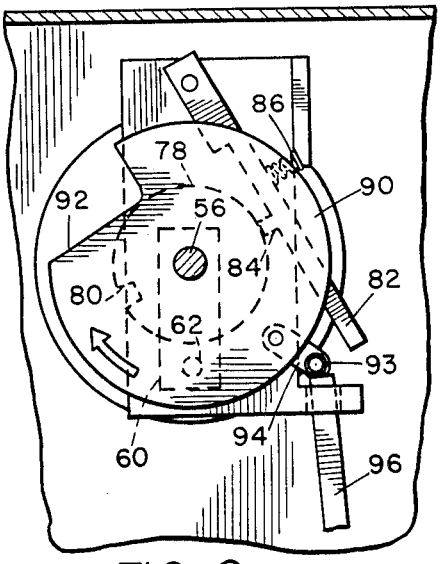

Rotation of the vault door lock in a direction to lock the vault door acts to open the slide door 31 to allow money to be deposited in the safe, as well as rotating the latching and arming mechanisms of the locking mechanism 52 into the positions shown in FIG. 6.

When the safe is full it can only be removed from the vault by rotation of the vault lock, and thus the locking mechanism 52, in the reverse direction to simultaneously release the vault door and close and lock the upper slide door 31. Unlocking of the vault door will rotate the shaft 56, and thus the latch wheel 78 and cam plate 90 back to the positions shown in FIG. 3. At this point the pawl is re-aligned with the notch 80 and is urged by the spring 86 back into the notch to lock the slide door 31 closed.

With this arrangement a person transporting the safe has no opportunity for access to the interior of the safe without actually tampering with the locks unless the safe is empty. The safe walls will be made of heavy duty material and the locks 38 and 42 will be high security locks to reduce the risk of tampering or break-ins. The safe cannot be removed from the vault without simultaneously locking the upper slide door, and the upper slide door can then only be re-opened when re-armed by unlocking of the lower slide door to unload the contents of the safe and subsequent re-locking of the lower door.

During transport of the empty safe back from a secure counting room to a vault, the locking mechanism will be in the position shown in FIG. 5. Thus although the person transporting the safe is at this time free to rotate the crank 72 to open the slide doors, if he does so he will be unable to lock the vault door when the safe is placed in the vault since the crank pin will not be correctly aligned with the notch in the vault door lock plate 64. If he then rotates the crank to align the notch correctly, the slide door will be locked closed and will only be able to be opened by turning of the lower door key to release the latch lever. Thus any attempts to tamper with the locking mechanism to jam the slide door open will be immediately apparent.

The upper slide door locking mechanism is separated from the money chambers 26 and 28 by a dividing wall 100 (see FIG. 2) to further reduce the risk of tampering.

In a modified embodiment the latch bar 96 may be raised and lowered by operation of the lower door handle 50 instead of by unlocking and re-locking of the lock 42.

There is preferably some type of indicator device associated with the vault and safe to indicate when the safe is full and needs replacing. This does not, however, form a part of the present invention.

Thus the safe loading door locking mechanism of this invention permits opening of the loading door only once in each cycle of loading an empty safe into a vault, depositing money in the safe, and returning the safe to a secure counting room. Any attempts to tamper with the locking mechanism by incorrectly opening the loading door prior to loading in the vault will be immediately apparent since it will no longer be possible to load the safe into the vault and re-open its loading door. The operator will have no option but to abandon the empty safe or return it to a counting room where an authorized person with the necessary lower door key can re-arm it.

Opening and closing of the loading door is done concurrently with locking and unlocking of the vault door, respectively. In the embodiment shown a single slide door acts to close both upper loading openings of the safe. However, separate slide doors may be provided in alternative embodiments.

The safe walls are bolted together by bolts engaging internal nuts which may be inserted via the various door openings during construction. This further reduces the risk of tampering.

Although a preferred embodiment of the invention has been described above by way of example it will be understood by those skilled in the field that modifications may be made to the disclosed embodiment without departing from the scope of the invention, which is defined by the appended claims.

We claim:

1. A mobile safe for locking within an outer container such as a vault, the safe comprising:

a housing having at least one upper loading door for receiving cash and at least one lower unloading door for removing cash from the safe;

an upper loading door actuating means for moving the upper door between an open and closed position;

an internally mounted upper loading door locking mechanism associated with said upper loading door actuating means for automatically locking the upper loading door in its closed position when said actuating means moves said upper door into said closed position;

a lower unloading door locking mechanism for locking the lower unloading door closed;

the upper loading door actuating means including external means for engagement with a vault door locking mechanism when the safe is placed in a vault and the vault door is closed, said external means comprising means for rotation into a first position in which the upper loading door is open when said vault door is locked, and for rotation into a second position in which said upper loading door is closed when said vault door is locked; and linkage means for linking said lower unloading door locking mechanism to said upper loading door locking mechanism, said linkage means comprising means for releasing said locking mechanism to allow said upper loading door to be opened when said lower unloading door is unlocked.

2. The mobile safe as claimed in claim 1, wherein said lower door locking mechanism includes a key operated latch, said linkage means being linked to said latch to release said upper loading door locking mechanism when said latch is released.

3. The mobile safe as claimed in claim 1, wherein said upper loading door actuating means includes a rotatable shaft and drive means linking said shaft to said upper loading door for moving said door in opposite directions in response to rotation of said shaft in opposite directions; said upper loading door locking mechanism comprising a latch wheel mounted on said shaft, a latching member, and bias means for urging said latching member into engagement with the outer face of said wheel, said latch wheel and latching member having co-operating means for latching engagement to prevent further rotation of said shaft when said shaft is rotated into a position corresponding to the fully closed position of said upper loading door.

4. The safe as claimed in claim 3, wherein said co-operating means comprises a notch on said latch wheel and a pawl on said latching member.

5. The safe as claimed in claim 3, wherein said linkage means includes lift means for lifting said latching member out of engagement with said latch wheel.

6. The safe as claimed in claim 5, wherein said lower door locking mechanism includes means connected to said lift means for raising it to release said latching member when said lower door is released and lowering said lift means when said lower door is re-closed, said linkage means further including holding means for retaining said latching member in its released position when said lower door is reclosed, and re-arming means for releasing said holding means when said rotatable shaft is rotated in a direction to open said upper loading door.

7. The safe as claimed in claim 6, wherein said re-arming means comprises cam means mounted on said shaft for urging said holding means to release said latching member when said shaft is rotated in a door-opening direction.

8. The safe as claimed in claim 7, further including a mounting plate, said latching member being pivotally mounted at one end on said plate, said holding means comprising a cam member acting between said lift means and said latching member and means for jamming said cam member in a raised position between said latching member and said mounting plate, said cam means having a surface for engagement with said cam member to urge it away from said latching member when said shaft is rotated in a door opening direction.

9. The safe as claimed in claim 3, wherein said shaft projects out of said housing through a wall facing a vault door when the safe is mounted in a vault, and crank means are mounted at the outer end of said shaft for engagement with co-operating means on the inner side of the vault door locking mechanism for rotating said shaft in an upper door opening direction when said vault door is locked and an upper door closing direction when said vault door is unlocked.

10. A locking mechanism for a safe having at least two access doors, one comprising a loading door for deposit of goods such as cash into the safe and the other comprising an unloading door for emptying the safe, the mechanism comprising:

an actuating means for moving a safe loading door between its open and closed positions;

a loading door locking mechanism for locking the actuating means against further movement when the safe loading door is closed;

a release mechanism for releasing the locking mechanism;

a safe unloading door locking mechanism for locking a safe unloading door closed;

linkage means linking the safe unloading door locking mechanism to the loading door release mechanism, the linkage means comprising means for urging the release mechanism in a direction to release the loading door locking mechanism when the unloading door is unlocked;

the actuating means including operating means for extending out of a safe for engagement with a vault door locking mechanism when the safe is positioned in a vault, the operating means comprising means for operating said actuating means to open said loading door when said vault door is locked and to close said loading door when said vault door is unlocked.

11. A mobile safe for releasably locking within an outer vault, the safe comprising:

a housing having at least one upper loading door for receiving cash and at least one lower unloading door for removing cash from the housing;

an actuating mechanism for moving the upper loading door between an open and closed position;

an upper loading door locking mechanism for automatically locking the actuating mechanism against further movement of the upper loading door whenever the upper loading door is closed;

an unloading door locking mechanism for locking the lower unloading door closed;

a release mechanism for releasing the upper loading door locking mechanism;

linkage means linking the unloading door locking mechanism to the release mechanism for automatically releasing the upper loading door locking mechanism when the unloading door is unlocked; and the actuating means including operating means for extending out of the safe for engagement with a vault door locking mechanism when the safe is positioned within a vault and the vault door is closed, the operating means comprising means for operating said actuating means to open said loading door when said vault door is locked and to close said loading door when said vault door is unlocked.

* * * * *